US007667595B2

(12) United States Patent
Komiya et al.

(10) Patent No.: US 7,667,595 B2
(45) Date of Patent: Feb. 23, 2010

(54) SECURITY SYSTEM USING SEQUENCE SIGNAL

(75) Inventors: Keinosuke Komiya, Tokyo (JP); Shoji Iibuchi, Saitama (JP)

(73) Assignees: Home Abroad Link Inc. (JP); Wako Engineering Co., Ltd. (JP)

( * ) Notice: Subject to any disclaimer, the term of this patent is extended or adjusted under 35 U.S.C. 154(b) by 0 days.

(21) Appl. No.: 11/585,914

(22) Filed: Oct. 25, 2006

(65) Prior Publication Data

US 2007/0035389 A1 Feb. 15, 2007

Related U.S. Application Data

(63) Continuation of application No. PCT/JP2005/009870, filed on May 30, 2005.

(30) Foreign Application Priority Data

May 28, 2004 (JP) ..... 2004-159886

(51) Int. Cl.
*G08B 13/22* (2006.01)
*G08B 29/00* (2006.01)

(52) U.S. Cl. ..... 340/540; 340/516; 340/5.22

(58) Field of Classification Search ..... 340/540, 340/516, 5.22, 5.27, 5.3, 539.22, 539.26; 341/22; 713/185; 307/10.4, 10.3
See application file for complete search history.

(56) References Cited

U.S. PATENT DOCUMENTS 3,769,515 A * 10/1973 Clark, Jr. ..... 250/341.7
4,688,020 A 8/1987 Kuehneman et al.
4,737,770 A * 4/1988 Brunius et al. ..... 340/539.22
4,857,914 A * 8/1989 Thrower ..... 340/5.54
5,709,114 A 1/1998 Dawson et al.
5,751,072 A 5/1998 Hwang
6,265,974 B1 7/2001 D'Angelo et al.
7,132,941 B2 * 11/2006 Sherlock ..... 340/539.26
2004/0059438 A1 3/2004 Sherlock

FOREIGN PATENT DOCUMENTS

EP 1345106 9/2003

(Continued)

OTHER PUBLICATIONS

European Search Report mailed Jan. 17, 2008 Application No. EP 05 74 3313.8.

(Continued)

*Primary Examiner*—Edwin C Holloway, III
(74) *Attorney, Agent, or Firm*—Studebaker & Brackett PC; Donald R. Studebaker

(57) ABSTRACT

There is provided an inexpensive and easy-to-use security system whose setting can be changed freely by a user using a target to be managed by the security system and whose presence is not easily perceived by an intruder.

The security system comprises security targets and a management system which manages the security targets. The security target comprises a plurality of activation switches which generate activation signals and a plurality of partial signal generating sections that generate partial signals which can constitute a predetermined sequence signal upon receipt of activation signals generated from the activation switches, in accordance with predetermined relationships with these activation switches. The management system compares partial signals generated from the partial signal generating sections with predetermined sequence information and gives an alarm when they do not match each other. The relationships between the activation switches and the partial signal generating sections can be changed freely by a user of the security target.

8 Claims, 5 Drawing Sheets

FOREIGN PATENT DOCUMENTS

| | | |
|---|---|---|
| EP | 1400939 | 3/2004 |
| JP | 03276395 | 12/1991 |
| JP | 07212849 | 8/1995 |
| JP | 08-319742 | 12/1996 |
| JP | 10-25934 | 1/1998 |
| JP | 10-82222 | 3/1998 |
| JP | 11-303478 | 11/1999 |
| JP | 2000-132765 | 5/2000 |
| JP | 2002-518759 | 6/2002 |
| JP | 2003074234 | 3/2003 |
| JP | 2003134501 | 5/2003 |
| JP | 2004058995 | 2/2004 |
| JP | 2004-129280 | 4/2004 |
| JP | 2004159886 | 6/2004 |

OTHER PUBLICATIONS

International Search Report mailed Jul. 5, 2005 PCT/JP2005/009870.

Japanese Official Action, issued Aug. 4, 2008, for the corresponding Japanese patent application.

Mexican Office Action dated Mar. 4, 2009; No. 18277 with English translation.

European Office Action dated May 19, 2009; Application No. 05743313.8-1248; Reference E1057/002(F).EP.

Response to European Office Action of May 19, 2009 for European Patent Application No. 05743313.8 dated Nov. 17, 2008.

* cited by examiner

SECURITY SYSTEM USING SEQUENCE SIGNAL

TECHNICAL FIELD

This invention relates to a security system, more specifically, to a security system using a sequence signal (information).

BACKGROUND ART

In recent years, the number of crimes has been only increasing on a global scale, and a more affordable and more effective security system has been strongly desired all over the world to protect a housing, an automobile, a personal computer and the like from a sneak thief, an illegal intruder, a hacker and the like. However, most of conventional security systems generally have a relatively complex structure, and despite having the relatively complex structure, their presences are often quickly perceived visually by an intruder, so that the security systems are often made ineffective before activated. Further, the security systems are generally managed by a security manager, and the settings of the security systems cannot be changed as required by a user, for example. Accordingly, for example, in the case of a rental apartment, a resident of the rental apartment cannot help but rely on a troublesome measure such as replacement of the key to protect the residence from ex-residents and contractors.

Patent Literature 1

Japanese Patent Laid-Open Publication No. 518759/2002 (discloses an example of conventional security systems.)

DISCLOSURE OF THE INVENTION

The present invention has been conceived to solve the above problems of the prior art. An object of the present invention is to provide a highly safe and easy-to-use security system which allows a user of a security target to change the setting of the security system freely. Another object of the present invention is to provide a security system whose presence is not easily perceived by an intruder.

To solve the above problems, the following security system is provided by the present invention.

The security system of the present invention is a security system comprising security targets and a management system which manages the security targets, wherein the security target comprises a plurality of activation switches which generate activation signals and a plurality of partial signal generating sections that generate partial signals which can constitute a predetermined sequence signal upon receipt of activation signals generated from the activation switches, in accordance with predetermined relationships with these activation switches, the management system compares partial signals generated from the partial signal generating sections of the security target with predetermined sequence information and gives an alarm when they do not match each other, and the relationships between the activation switches and the partial signal generating sections can be changed freely by a user of the security target.

The above system may be such that the partial signal generating sections generate any of the partial signals which can constitute the predetermined sequence signal in turn upon receipt of the activation signals generated from the activation switches, and the management system compares the generated partial signals with the sequence information stored in advance in the management system in turn and gives an alarm at the point when the management system determines that they do not match each other. The management system may compare the generated partial signals with the sequence information stored in advance in the management system at once and give an alarm when they do not match each other.

In the above security system, the sequence information stored in the management system in advance is not changed without notifying the user of the security target in advance.

The above security system may give an alarm when the partial signals generated from the partial signal generating sections of the security target in turn and the sequence information stored in advance in the management system do not match each other completely or partially.

In the above security system, the switches may be collected in one place or disposed in different places. The former has an advantage that the switches can be used easily, while the latter has an advantage that the switches can visually deceive an intruder or the like easily.

The above security system may give an alarm when the sequence information stored in the management system in advance and the sequence signal generated by the security target do not match each other within a predetermined time or even by operating the switches for a predetermined number of times.

According to the present invention, an inexpensive and easy-to-use security system having a simple structure can be provided.

BEST MODE FOR CARRYING OUT THE INVENTION

Figure 1:
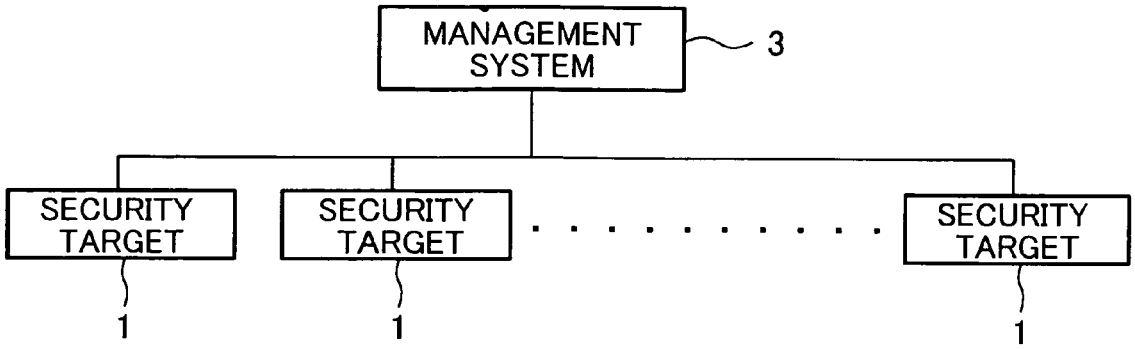
FIG. 1 is a conceptual diagram of a security system according to the present invention.

A suitable embodiment of a security system according to the present invention will be described with reference to the attached drawings. FIG. 1 is a conceptual diagram of the security system according to the present embodiment. The security system comprises one or more security targets 1 which are targets to be secured and a management system 3 which is connected to the security target(s) 1 to manage the security target(s). The security target 1 may be a living space, a personal computer, an automobile, a ship or an aircraft, for example. The management system 3 may be a security company or a neighbor, for example.

Figure 2:
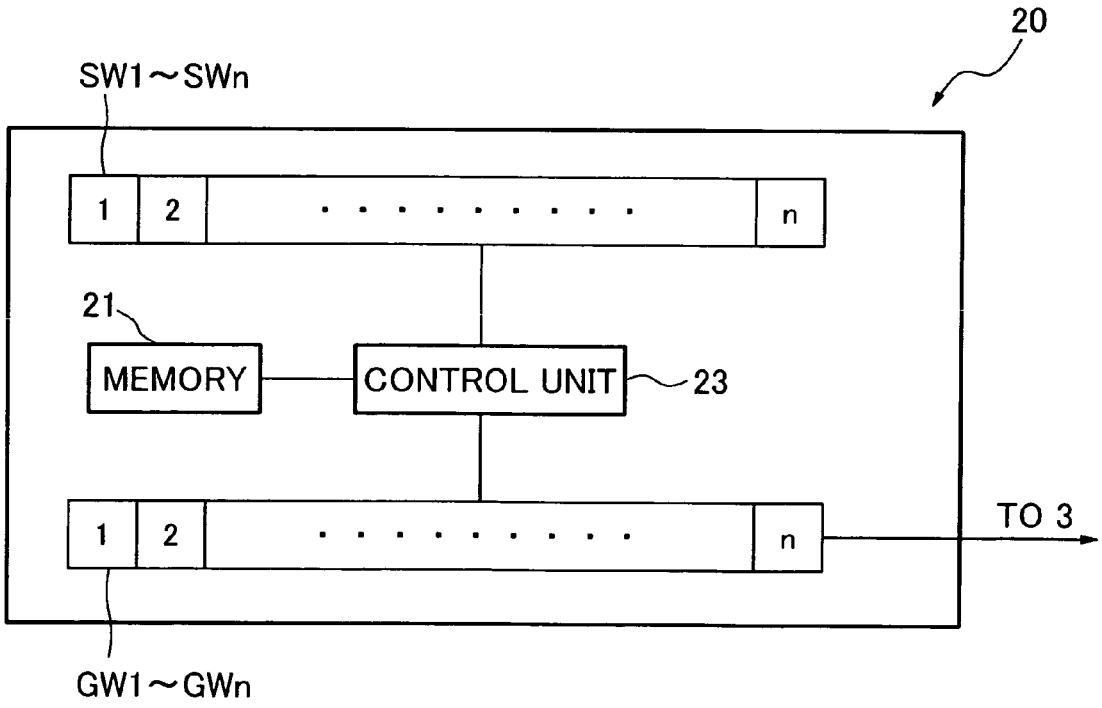
FIG. 2 is a block diagram showing the constitution of a sequence signal generator.

When the present security system is used, equipment required by the security target 1 is only a sequence signal generator 20. The sequence signal generator 20 generates a predetermined sequence signal according to a predetermined operation of a predetermined portion of each security target 1. FIG. 2 is a block diagram showing the constitution of the sequence signal generator 20 briefly.

The sequence signal generator 20 primarily comprises a plurality of activation switches SW1 to SWn, a plurality of partial signal generating sections GW1 to GWn, a memory 21, and a control unit 23 which controls these components.

The activation switches SW1 to SWn may be switches that are placed in a predetermined portion of the security target 1 and generate an activation signal of some type according to a predetermined operation in the predetermined portion. Basically, the "signal" used in the present specification is a term which includes not only an electrical signal but also a wide range of other media which can transmit information of some type, e.g. pressure or heat. What are used as these activation switches, the predetermined portion, the predetermined operation and what is used as the activation signal can be determined freely by a designer of the security system or a user of the security target 1. For example, when the security target is a living space, a lamp switch, a television switch and water coming out of a faucet (more specifically, a flow relay which detects the flow of water coming out of a faucet) can be used as the activation switches SW1 to SWn; when the security target is a personal computer, keys of the personal computer can be used as the activation switches SW1 to SWn; and when the security target is an automobile, the room light, horn, accelerator and brake of the automobile can be used as the activation switches SW1 to SWn. Further, as the predetermined portion when the security target is a living space, an operation panel for a lamp switch or a string extending from a lamp switch for operating the switch can be used, for example. As the predetermined operation in this case, it is conceivable to operate the operation panel or pull the string, for example. Further, as the activation signal in this case, generation of electric current or a change in generated electric current can be used, for example.

The activation switches SW1 to SWn may be those which function merely as activation switches. However, these activation switches SW1 to SWn may also be those which have functions other than those of the activation switches SW1 to SWn, e.g. lamp switches. Use of activation switches having other functions has an advantage that the presence of the security system can be hardly perceived by a criminal or the like. Further, the activation switches SW1 to SWn may be collected in one place as one panel switch or may be disposed in different places as completely different switches. The former has an advantage that ease of use of the activation switches is improved, while the latter has an advantage that the activation switches can be made visually deceptive to an intruder or the like. Further, even in the former case, the activation switches can be made visually deceptive to an intruder or the like by using them in combination with a normal lamp switch panel or making them have the same appearance as that of the normal lamp switch panel.

The partial signal generating sections GW1 to GWn generate any of partial signals that can constitute a predetermined sequence signal in turn upon receipt of activation signals generated from the activation switches SW1 to SWn according to the predetermined relationships with the activation switches SW1 to SWn. These partial signals generated in turn from the partial signal generating sections GW1 to GWn are sent to the management system 3 in the order in which they are generated, for example. Thus, from the view point of the management system 3, it can be said that a collection of these partial signals can constitute the predetermined sequence signal. Further, the partial signals may be any signals that can be differentiated from one another and may be numbers or alphabets, for example.

Figure 3:
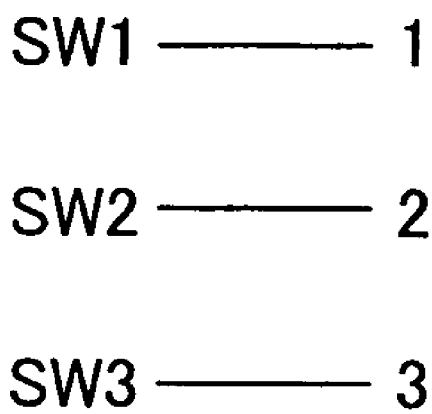
FIG. 3 is a diagram showing an exemplary relationship between activation switches and partial signal generating sections.

The memory 21 stores the relationships (correlations) between the activation switches SW1 to SWn and the partial signal generating sections GW1 to GWn. For example, as shown in FIG. 3, the memory 21 can store that the activation switch SW1 is associated with the partial signal generating section GW1 that generates a predetermined partial signal "1", the activation switch SW2 is associated with the partial signal generating section GW2 that generates a predetermined partial signal "2", and the activation switch SW3 is associated with the partial signal generating section GW3 that generates a predetermined partial signal "3".

Under the above settings, when the activation switches SW1, SW2 and SW3 are operated in this order, for example, activation signals are generated from the activation switches SW1, SW2 and SW3 in turn. Upon receipt of these activation signals, partial signals "1", "2" and "3" are generated from the partial signal generating sections GW1 to GW3 in turn. Eventually, the partial signals (sequence signal) "1", "2" and "3" are sent to the management system 3 in turn. Under the same settings, when the activation switches SW2, SW3 and SW1 are operated in this order, for example, partial signals (sequence signal) "2", "3" and "1" are sent to the management system 3 in turn.

In the present system, the data stored in the memory 21, that is, the relationships between the activation switches SW1 to SWn and the partial signal generating sections GW1 to GWn, can be set or changed freely by a user. In this regard, the present system is completely different from such a normal security system as installed at the entrance of a room which is under security management. A user can set the contents of the memory 21 freely before starting to use the present system and can change its contents freely as required thereafter. These settings and changes are known to only a user who made the settings and changes, and the information is not revealed to a manager or others. Further, the contents of the management system 3 are not altered in response to these settings and changes.

Figure 4:
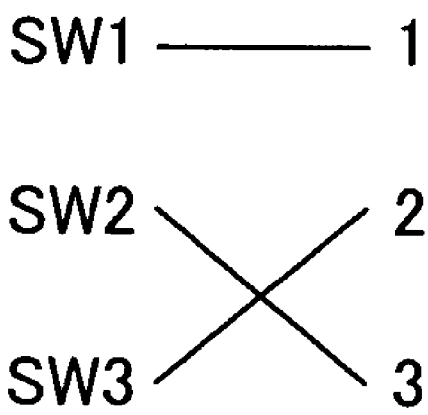
FIG. 4 is a diagram showing the changed relationship between the activation switches and the partial signal generating sections.

With reference to FIG. 4, an effect resulting from changing the setting will be described. For example, it is assumed that the setting shown in FIG. 3 has been changed to that shown in FIG. 4. In this case, a partial signal "1" has been associated with the switch SW1, a partial signal "2" has been associated with the switch SW2, and a partial signal "3" has been associated with the switch SW3, before changing the setting, while a partial signal "1" is associated with the switch SW1, a partial signal "3" is associated with the switch SW2, and a partial signal "2" is associated with the switch SW3, after changing the setting. As a result, for example, when the switches are operated in the order of SW1, SW2 and SW3 as described above, the partial signals "1", "2" and "3" are generated in turn before changing the setting, and the partial signals "1", "3" and "2" are generated in turn after changing the setting. It is obvious that by changing the setting as described above, the partial signals are generated in a different order, that is, different sequence signals are generated, even by the same operation. Therefore, only a user who changes the setting will know an operation method for generating a predetermined sequence signal. The present invention enables a user to manage security based on this principle.

Figure 5:
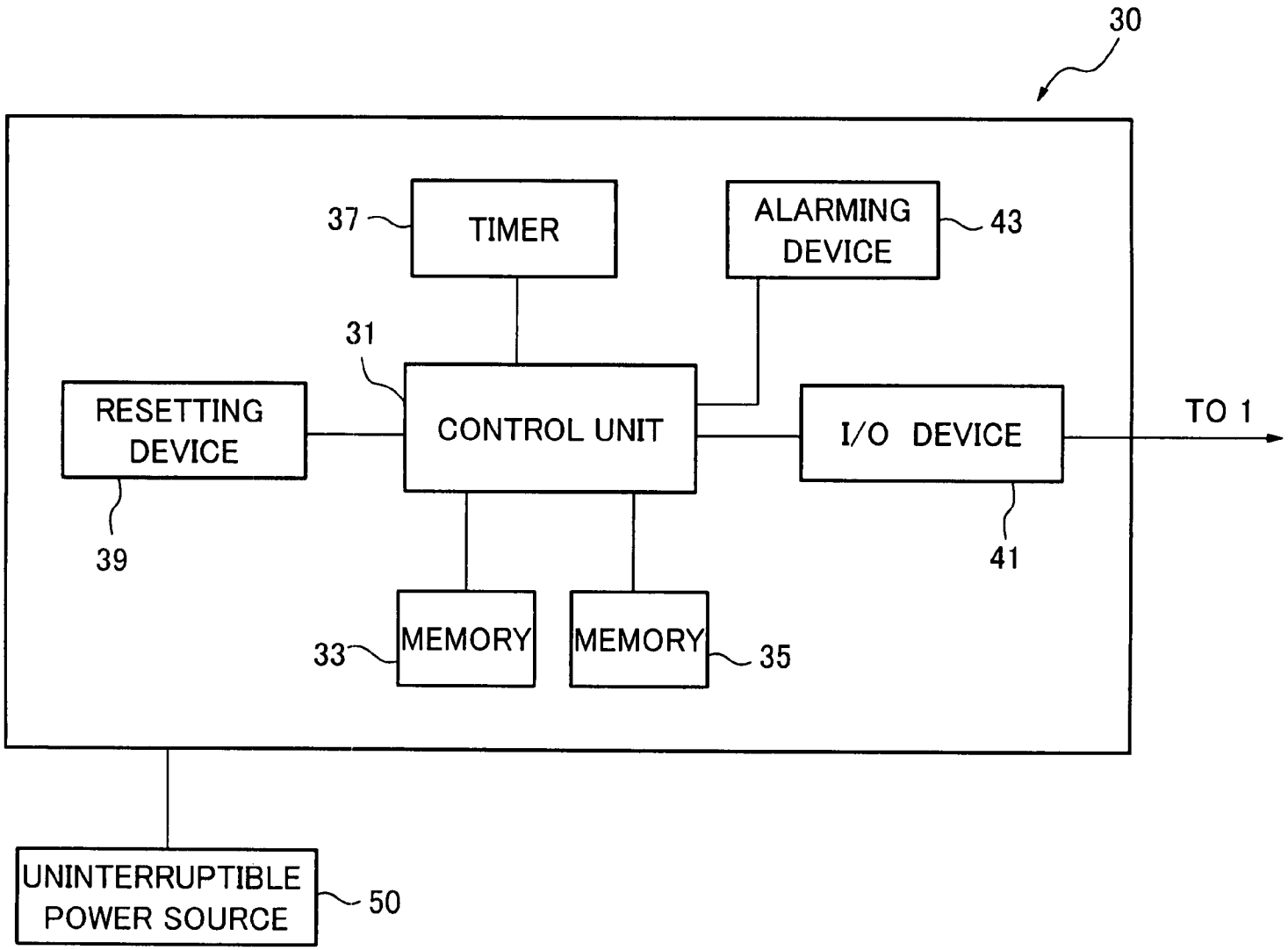
FIG. 5 is a block diagram showing the constitution of a control device.

The primary function of the management system 3 is to check whether a sequence signal generated from a security target 1 is the same as sequence information stored in advance in the management system 3 and give an alarm when they do not match each other. To perform these operations, the management system 3 has a control device 30. FIG. 5 is a block diagram showing the constitution of the control device 30 briefly.

The control device 30 primarily comprises a control unit 31, a memory 33 which is connected to the control unit 31 and stores predetermined sequence information, a memory 35 which stores an operation program of the control unit 31, a timer 37, a resetting device 39 which resets the control device 30, an I/O device 41 for communicating with a security target 1, and an alarming device 43. The power source of the control device 30 may be a general power source for domestic use but may also be an uninterruptible power source 50, for example. By use of the uninterruptible power source 50, it can be prevented, for example, that an intruder makes security ineffective before intrusion by, for example, cutting power to a security target 1, and malfunction caused by power failure can also be prevented.

The control unit 31 receives partial signals (sequence signal) sent from the sequence signal generator 20 in turn via the I/O device 41 and, for example, compares these partial signals with sequence information stored in advance in the memory 33 in turn. Unlike the memory 21 of the sequence signal generator 20, the contents of the sequence information stored in the memory 33 are set by a manager of the management system 3 and are basically not changed once they are set.

When the control unit 31 has found that the contents of the sequence signal and sequence information completely match each other as a result of comparing them, it determines that these partial signals are signals generated by a valid user and gives no alarm. Meanwhile, when the control unit 31 has found that the contents do not match each other even partially, it determines that these partial signals are signals generated by an illegal intruder at the point when it has found that the contents do not match each other, i.e. when it has received the unmatched partial signals and sends a signal to the alarming device 43.

In response to the signal, the alarming device 43 communicates with the outside. The communication with the outside is preferably carried out by wireless so as to make it difficult for an intruder to render the reporting system ineffective by disconnection or the like. The alarming device 43 may communicate with multiple spots including the cellular phone of a user, a security company and a neighbor of each security target 1 and may communicate with these spots simultaneously. Thereby, illegal intrusion can be detected quickly and easily, and security management can be handled by a neighbor who may live in the closest place to an intruder.

In the above constitution, the timer 37 can be used, for example, in such a manner that it times time from reception of a partial signal to reception of the next partial signal and sends a signal to the alarming device 43 when the time becomes long.

As is obvious from the above description, the present system is basically assumed to cause an intruder to generate an invalid sequence signal. However, the present system may also be used in such a manner that a user generates an invalid sequence signal to inform the outside of the presence of an intruder. That is, the present system can also be used as a normal alarm bell. For example, by use of the present system, a single female can ask a neighbor for help easily without letting an illegal intruder know her doing that.

Various variations of the above embodiment are possible. For example, in the above embodiment, the control unit 31 determines that the partial signals generated in turn from the security target 1 are signals generated by a valid user only when the partial signals and the sequence signal stored in the memory 33 of the management system 3 match each other completely, in other words, by checking all the partial signals generated in turn. The present invention is not limited to the above embodiment, and the control unit 31 may determine that the partial signals generated in turn are signals generated by a valid user by checking only some of the partial signals. For example, it is possible to leave the first to (n−1)th partial signals unconcerned and use only the (n)th partial signal for determination of the valid user. According to such a method, a system which tolerates an erroneous operation only for a predetermined number of times can be provided, for example. Further, it is also possible to compare the partial signals generated in turn from the security target 1 with the sequence information stored in the memory 33 of the management system 3 at once (at a time) for the first time when the partial signals generated in turn from the security target 1 are collected (or when the sequence signal is constituted).

Further, in the above embodiment, it has been described that the contents of the memory 33 are not changed in principle once they are set. However, against the principle, it is also possible to render the data set in the memory 33 changeable. For example, the setting may be changed on a weekly basis to improve the integrity of security. However, when a manager is to change the setting, he needs to inform a user of how he intends to change the setting in advance in such a manner that an intruder cannot find out the change in the setting. As is obvious, in this case, the user will need to change the contents of the memory 21 (refer to FIG. 2) that the user controls, i.e. the relationships between the activation switches SW1 to SWn and the partial signal generating sections GW1 to GWn or change a method of operating the activation switches SW1 to SWn, in response to the change in the setting in the memory 33.

EXAMPLE 1

Hereinafter, an example of application of the security system according to the present invention to, for example, a living space will be described.

1. Living Room

Figure 6:
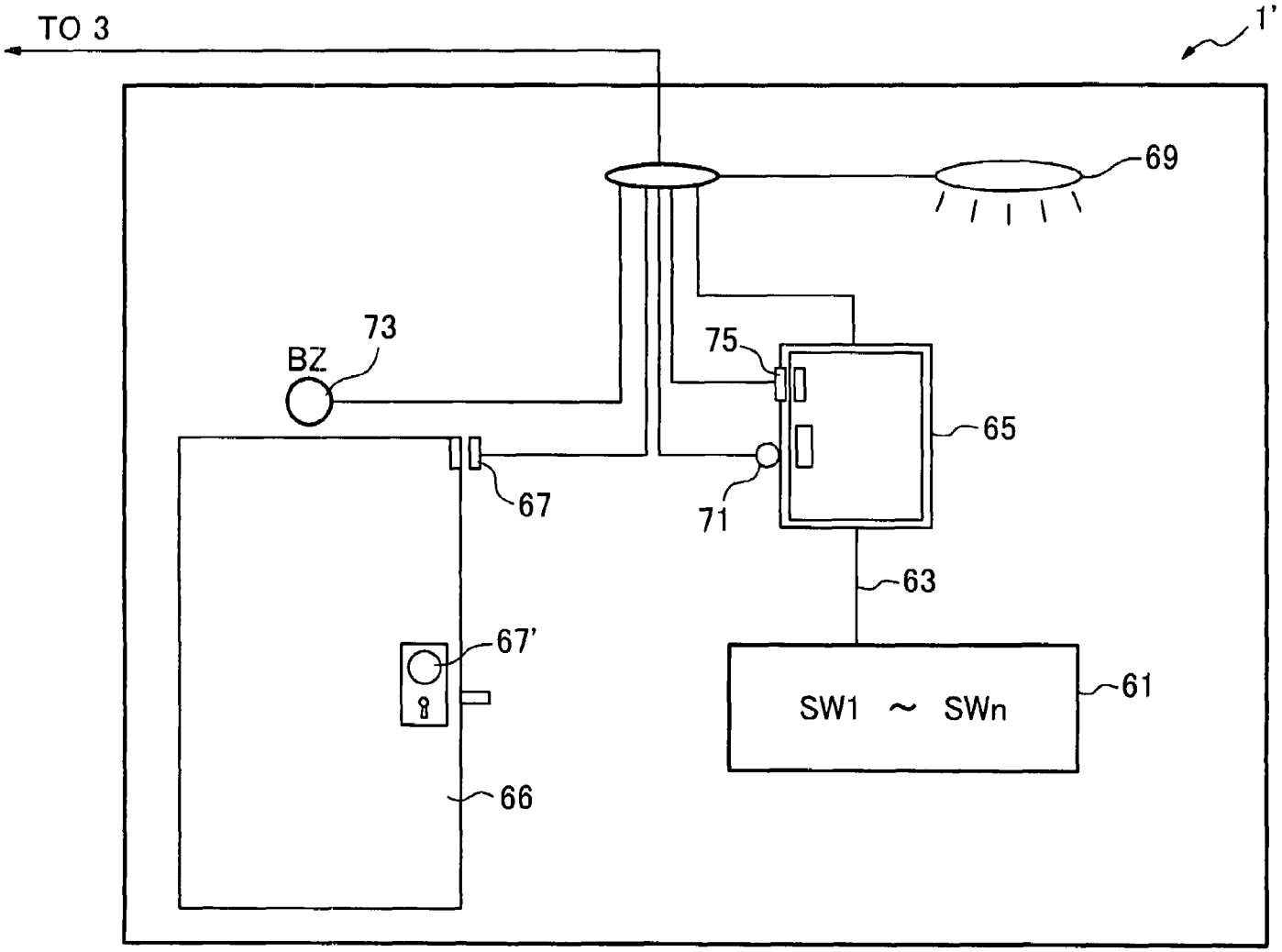
FIG. 6 is a block diagram showing an exemplary application of the present system to a living room.

FIG. 6 is a block diagram showing the constitution of a living room which is a security target briefly. This living room 1 has various gimmicks for activating the present security system or for other purposes.

Each living room 1' which is a security target has a plurality of activation switches SW1 to SWn. Lamp switches, television switches or air conditioning switches may be used as the activation switches, and as activation signals, electrical signals generated or changes in electric currents occurring when the switches are operated may be used. The activation switches SW1 to SWn not only serve as switches but also serve as the activation switches SW1 to SWn. These activation switches SW1 to SWn may be collected in one place as one panel switch 61 or may be disposed in different places as completely different switches.

For example, it is assumed that a lamp switch SW1 is associated with the partial signal generating section GW1 which generates a partial signal "1", a television switch SW2 is associated with the partial signal generating section GW2 which generates a partial signal "2" and an air conditioning switch SW3 is associated with the partial signal generating section GW3 which generates a partial signal "3". In this case, when the lamp switch SW1, the television switch SW2 and the air conditioning switch SW3 are operated in this order, partial signals "1", "2" and "3" are generated from the partial signal generating sections GW1 to GWn in turn according to the above operation order. The management system 3 compares the partial signals generated in turn with sequence information, e.g. "1-2-3", stored in advance in the memory 33 so as to confirm whether the partial signals have been generated in a correct order. For example, when the television switch SW2, the air conditioning switch SW3 and the lamp switch SW1 are operated by an intruder in this order, partial signals "2", "3" and "1" are generated from the partial signal generating sections GW1 to GWn in turn according to the above operation order. As a result, upon receipt of the partial signal "2", the management system 3 finds that the received signal is different from the first "1" in the sequence information "1-2-3" stored in the management system 3, thereby giving an alarm.

To deceive an intruder, a resident (user) of the living room 1' (not the management system 3) as a security target can change the relationships between the activation switches SW1 to SWn and the partial signal generating sections GW1 to GWn freely. How the relationships have been changed are known to only the user who has changed them. That is, only the resident can know the order of operation of the activation switches, and an intruder cannot know the operation order. For example, a new resident can change the relationships between them freely when moving into the room and can still change them freely as desired even after settling in the room. Thus, according to the present system, it can be prevented freely and effectively that an ex-resident or contractor breaks into the residence. Further, to allow each resident to change the setting easily, a device for changing the relationships between the activation switches SW1 to SWn and the partial signal generating sections GW1 to GWn, that is, the sequence signal generator 20, is preferably installed in each living room 1', for example.

In addition to the above basic constitution, a door switch 67 having an alarm function, a lighting apparatus 69 having an alarm function and warning buzzers 71 and 73 may be further provided to improve the effectiveness of the present system. All of these devices are connected to the management system 3 by the same means as connection means 63.

The door switch 67 with an alarm function detects that a door 66 which is frequently used when a resident goes out or a backdoor which is often targeted by an intruder is opened and sends an alarm signal to the management system 3, for example. The door switch 67 with an alarm function does not necessarily have to be installed in the upper portion of the door. The switch 67 may be installed such that it works with a doorknob 67', for example. The lighting apparatus 69 with an alarm function detects lighting of a lamp which is highly likely to be used by an intruder or a lamp which can be lit automatically when an intruder enters the residence and sends an alarm signal to the management system 3. Further, as warning buzzers, two types of warning buzzers, i.e. the warning buzzer 71 and the warning buzzer 73 having an alarm function, may be provided. The former warning buzzer 71 merely informs a resident of an erroneous operation of the activation switches SW1 to SWn and sends no warning signal to the management system 3, while the latter warning buzzer 73 having an alarm function not only informs the outside of illegal intrusion by an alarm but also sends a warning signal to the management system 3.

2. Management System

The control unit 31 receives a sequence signal from the sequence signal generator 20 or a warning signal from the door switch 67 having an alarm function via the I/O device 41 and controls them in an integrated manner. In particular, the control unit 31 receives partial signals generated from the sequence signal generator 20 in turn and compares the sequence signal with sequence information stored in the memory 33 of the control unit 31 in advance. When they match each other, the control unit 31 determines that the sequence signal is a sequence signal generated by a valid resident and ends warning. Meanwhile, when they do not match each other, the control unit 31 determines that the sequence signal is a sequence signal generated by an illegal intruder and sends a signal to the alarming device 43. The sequence information stored in the memory 33 in advance is basically not changed once it is set. In order to prevent an intruder from changing the setting, a door switch 75 which is similar to the door switch 67 having an alarm function may be provided to the door of the sequence signal generator 20 (refer to FIG. 6).

3. Operation Example

Figure 7:
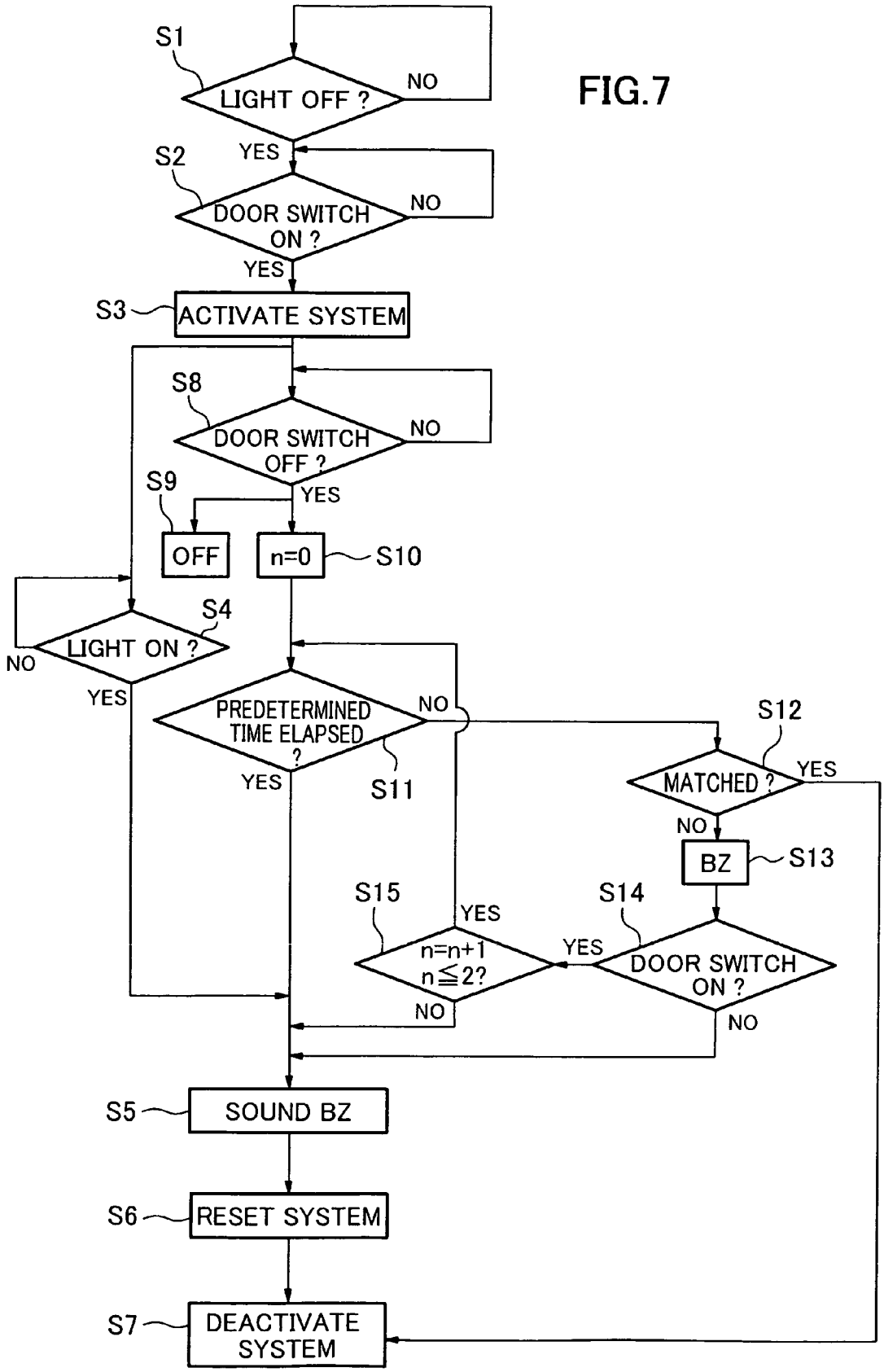
FIG. 7 is a flowchart showing an exemplary operation of the system of FIG. 6.

A suitable operation example of the security system will be described with reference to FIG. 7. FIG. 7 is a flowchart showing the flow of steps carried out by the foregoing management system 3. The contents of these steps are stored in the memory 35 (refer to FIG. 5) of the control device 30, for example. This drawing merely illustrates one operation example. Therefore, the present system is not limited to this operation example.

The present system can be activated and placed on alert automatically (STEP 3) by operations that a resident normally goes through when going out, e.g. turning off the light (STEP 1) and locking the door, i.e. turning on the door switch (STEP 2). This method does not allow an illegal intruder to sense activation of the system even when the intruder has monitored the movements of the resident. Similarly, the present system can also be activated and placed on alert automatically by operations that the resident normally goes through before going to bed, i.e. locking the door and turning off the light. This method can easily prevent the resident from forgetting to turn on the switch of the security system.

Upon activation of the security system, various alarm functions (not shown) are activated, and the security system starts to check whether the lighting apparatus 69 having an alarm function is lit (STEP 4). For example, when the lighting apparatus 69 has been lit by intrusion of an illegal intruder even when the intruder has entered the residence from a window without opening the door, the control unit 31 can inform the resident and others of the illegal intrusion immediately by sounding the warning buzzer 73 (BZ) having an alarm function and sending a signal to the alarming device 43 (STEP 5). After completion of elimination of the intruder, the system is reset by the resetting device 39 (STEP 6) and thereby released from alert (STEP 7).

In STEP 4, when the door is opened with the lighting apparatus 69 unlit, that is, when someone enters the room in a normal manner, the door switch having an alarm function is turned off automatically (STEP 8), and the switch of the lighting apparatus 69 is also turned off (STEP 9). Then, a variable "n" is set at an initial value of "0" (STEP 10), and the timer 37 starts to count time (STEP 11). As is clear from the following description, this variable "n" is required for counting the number of erroneous operations of the activation switches SW1 to SWn.

In STEP 11, it is checked, within a predetermined time, whether the activation switches SW1 to SWn have been operated correctly, i.e. whether a sequence signal received from each living room 1' has matched sequence information stored in advance in the memory 33 of the control unit 31 (STEP 12). When the predetermined time has elapsed before matching of the data is confirmed, e.g. when an illegal intruder fails to perform a predetermined operation within the predetermined time, the control unit 31 sounds the warning buzzer 73 (BZ)

and sends a signal to the alarming device 43 (STEP 5), followed by the foregoing STEPS 6 and 7.

In STEP 12, when matching of the data has been confirmed within the predetermined time (STEP 11), the system is released from alert (STEP 7). Further, if operations from activation of the system to deactivation of the system are coincided with operations that the resident normally goes through when coming home as in the case of the operations for activating the system, the security system can be deactivated by natural movements of the resident. Thereby, concern that an illegal intruder may find out the presence of the security system can be reduced.

Meanwhile, in STEP 12, when matching of the data has not been confirmed, that is, when the activation switches SW1 to SWn have not been operated correctly, within the predetermined time (STEP 11), the control unit 31 sounds the warning buzzer (BZ) 71 (STEP 13) and checks whether the door of the sequence signal generator 20 has been opened, i.e. whether the door switch 75 remains in the ON state (STEP 14). When the door switch is in an OFF state, the control unit 31 sends a signal to the alarming device 43 (STEP 5). Meanwhile, when the door switch remains in the ON state, the control unit 31 adds 1 to the variable n and checks whether $n \leqq 2$ holds (STEP 15). When $n \leqq 2$ holds, that is, when the number of erroneous operations performed within the predetermined time is 2 or less, the control unit 31 returns to STEP 11 to repeat the predetermined operations. Meanwhile, when $n>3$ holds, that is, when the number of erroneous operations performed within the predetermined time is more than 3, the control unit 31 sends a signal to the alarming device 43 (STEP 5).

As is obvious, various modifications can be made on the present system. For example, the lighting apparatus 19 having an alarm function can be used in combination with the activation switches SW1 to SWn. In this case, STEP 4 in FIG. 4 can be omitted. The present invention includes all of such various variations.

EXAMPLE 2

The present system can also be applied to a personal computer to protect the computer from hackers. For example, when the activation switch SW1 is allocated to an "a" key, the activation switch SW2 is allocated to a "b" key and the activation switch SW3 is allocated to a "c" key of the personal computer, an alarm is set off immediately if the keys are not operated in the order of "a", "b" and "c". Hence, according to the present system, since an alarm is set off immediately at the point when a hacker operates the personal computer to look for the password to the computer, security can be further enhanced.

EXAMPLE 3

The present system can also be applied to an automobile to protect the automobile from thieves. For example, it is possible that with the activation switch SW1 allocated to the left front door, the activation switch SW2 allocated to the right rear door and the activation switch SW3 allocated to the room light of the automobile, the control unit 31 determines that only one who has opened the left front door and the right rear door and then lit the room light is the valid owner of the automobile and determines that one who has performed operations other than these is not the owner of the automobile and gives an alarm. Thereby, automobile theft can be prevented easily and effectively. In a similar manner, the present system can also be applied to an aircraft and a ship.

Thus, by placing the activation switches of the present system in places which are hardly detected by a criminal, the security of various security targets can be improved easily at low cost and with a simple structure.

INDUSTRIAL APPLICABILITY

The present system is applicable to various targets requiring a security system.

The invention claimed is:

1. A security system, comprising:

a security target; and a management system configured to manage the security target and to store predetermined sequence information, wherein the security target includes a sequence signal generator, the sequence signal generator includes:

a plurality of activation switches, each activation switch generates activation signals, and a plurality of partial signal generating sections, each partial signal generating section generates unique partial signals constituting a sequence signal, upon receipt of the activation signals, each activation switch corresponds to any of the partial signal generating sections according to corresponding relationships, when an activation signal is generated from an activation switch, the partial signal generating section corresponding to the activation switch according to the corresponding relationships receives the activation signal and generates a unique partial signal, wherein the management system is configured to compare the sequence signal generated from the sequence signal generator with predetermined sequence information, which remains unchanged even when the corresponding relationships are changed, and to signal an alarm when the sequence signal generated and the predetermined sequence information do not match each other, and wherein corresponding relationships between activation signals generated from the activation switches and partial signals generated from the partial signal generating sections are freely changeable, in the security target, by a user of the security target without informing the management system and without changing the predetermined sequence information, such a change in the corresponding relationships between activation signals generated from the activation switches and partial signals generated from the partial signal generating sections made by the user is known only to the user, and only when the predetermined sequence information is changed, the management system is to inform the user of such change of the predetermined sequence information.

2. The security system of claim 1, wherein the partial signal generating sections generate any of the partial signals which can constitute the predetermined sequence signal in turn upon receipt of the activation signals generated from the activation switches, and the management system compares the generated partial signals with the sequence information stored in advance in the management system in turn and gives an alarm at the point when the management system determines that they do not match each other.

3. The security system of claim 1, wherein the sequence information stored in the management system in advance is not changed without notifying the user of the security target in advance.

4. The security system of claim 1, which gives an alarm when the partial signals generated from the partial signal generating sections of the security target in turn and the sequence information stored in advance in the management system do not match each other completely.

5. The security system of claim 1, which gives an alarm when the partial signals generated from the partial signal generating sections of the security target in turn and the sequence information stored in advance in the management system do not match each other partially.

6. The security system of claim 1, which gives an alarm when the sequence information stored in the management system in advance and the sequence signal generated by the security target do not match each other within a predetermined time.

7. The security system of claim 1, which gives an alarm when the sequence information stored in the management system in advance and the sequence signal generated by the security target do not match each other even by operating the switches for a predetermined number of times.

8. The security system of any of claim 1, wherein the activation switches are disposed in different places.

* * * * *